US011613889B2

(12) United States Patent
Preston

(10) Patent No.: US 11,613,889 B2
(45) Date of Patent: Mar. 28, 2023

(54) WEEPING CONTROL JOINT SYSTEM

(71) Applicant: Innovations & Ideas, LLC, Tampa, FL (US)

(72) Inventor: Steven Preston, Tampa, FL (US)

(73) Assignee: INNOVATIONS & IDEAS, LLC, Tampa, FL (US)

( * ) Notice: Subject to any disclaimer, the term of this patent is extended or adjusted under 35 U.S.C. 154(b) by 0 days.

(21) Appl. No.: 17/063,002

(22) Filed: Oct. 5, 2020

(65) Prior Publication Data

US 2021/0102372 A1 Apr. 8, 2021

Related U.S. Application Data

(60) Provisional application No. 62/911,092, filed on Oct. 4, 2019.

(51) Int. Cl.
*E04B 1/70* (2006.01)
*E04F 13/04* (2006.01)

(52) U.S. Cl.
CPC ..... *E04B 1/7046* (2013.01); *E04B 1/7076* (2013.01); *E04F 13/04* (2013.01)

(58) Field of Classification Search
CPC ..... E04F 13/04; E04F 13/06; E04F 13/007; E04B 1/765; E04B 1/68; E04B 1/7046; E04B 1/7076; E04B 1/70; E04B 1/7038; E04B 1/7069; E04B 1/7084
See application file for complete search history.

(56) References Cited

U.S. PATENT DOCUMENTS

| | | | | |
|---|---|---|---|---|
| 5,946,870 | A * | 9/1999 | Bifano | E04B 1/765 52/60 |
| 6,293,064 | B1 * | 9/2001 | Larson | E04F 13/068 52/302.1 |
| 6,298,609 | B1 * | 10/2001 | Bifano | E04F 19/02 52/302.3 |
| 7,634,883 | B1 * | 12/2009 | Larson | E04F 13/06 52/573.1 |
| 7,874,123 | B2 | 1/2011 | Maziarz | |
| 8,815,944 | B2 | 8/2014 | Leroux | |
| 9,279,247 | B2 | 3/2016 | Maziarz | |
| 10,024,063 | B2 * | 7/2018 | Friel | E04B 1/70 |
| 10,196,812 | B1 * | 2/2019 | Duffy | E04F 13/007 |
| 10,358,814 | B2 | 7/2019 | Maziarz | |
| 10,494,818 | B2 * | 12/2019 | Maziarz | E06B 7/2303 |
| 10,648,184 | B2 | 5/2020 | Maziarz | |
| 10,731,335 | B2 * | 8/2020 | Baltz, Jr. | E04B 1/7038 |

(Continued)

FOREIGN PATENT DOCUMENTS

CA 2666118 C 8/2017

OTHER PUBLICATIONS

US 9,082,453 B2, 06/2015, Maziarz (withdrawn)

(Continued)

*Primary Examiner* — Jessica L Laux
(74) *Attorney, Agent, or Firm* — Christopher Paradies; Paradies Law P.A.

(57) ABSTRACT

Drainage channels are added to a control joint to provide a weeping control joint wherein condensate or other sources of water that finds its way between the stucco and the substrate, above the weeping control joint, flows through the channels to the exterior surface of the stucco below the weeping control joint.

19 Claims, 10 Drawing Sheets

(56) References Cited

U.S. PATENT DOCUMENTS

| | | | | |
|---|---|---|---|---|
| 2003/0126810 | A1* | 7/2003 | Brunson | E04F 17/00 52/302.3 |
| 2014/0245676 | A1 | 9/2014 | Maziarz | |
| 2014/0245677 | A1 | 9/2014 | Maziarz | |
| 2017/0130462 | A1 | 5/2017 | Maziarz | |
| 2017/0254091 | A1* | 9/2017 | Friel | E04F 19/02 |
| 2018/0112414 | A1* | 4/2018 | Maziarz | E06B 7/2303 |
| 2018/0195272 | A1 | 7/2018 | Maziarz | |
| 2019/0136549 | A1 | 5/2019 | Maziarz | |
| 2019/0194954 | A1* | 6/2019 | Baltz, Jr. | E04B 1/7076 |
| 2020/0240153 | A1 | 7/2020 | Maziarz | |
| 2021/0180335 | A1 | 6/2021 | Maziarz | |
| 2021/0207381 | A1 | 7/2021 | Maziarz | |

OTHER PUBLICATIONS

Amico Hydrodry, Amiflow Ultra Drain, 2 pages.
Amico Hydrodry, rain screen 2 pages.
Amico Hydrodry, Moisture Management Sotution, E-Z Vent, 2 pages.
Amico Hydrodry, Amiflow mid-wall drain screed, 2 pages.
Amico Hydrodry, Moisture Management Solution, Amiflow Drain Screed, 2 pages.
Amico Stone final, 6 pages.
Amico Stucco final, 4 pages.
Amico Siding Final, 9 pages.

* cited by examiner

WEEPING CONTROL JOINT SYSTEM

CROSS RELATED APPLICATIONS

This application claims priority to U.S. Provisional Appln. No. 62/911,092, which was filed Oct. 4, 2019, and is herby incorporated by reference herein in its entirety.

FIELD OF THE INVENTION

The field relates to construction of a building using stucco or other cementitious materials for an exterior protective and decorative outside wall covering and for waterproofing

BACKGROUND

Stucco has been used since ancient times. Still widely used throughout the world, it is one of the most common of traditional building materials. Up until the late 1800's, stucco, like mortar, was primarily lime-based, but the popularization of portland cement changed the composition of stucco, as well as mortar, to a harder material, although stucco may be made of any of a variety of cementitious materials. Historically, plaster has often been interchangeable with stucco and is still favored by many, particularly when referring to the traditional lime-based coating. By the nineteenth century stucco, although originally denoting fine interior ornamental plasterwork, had gained wide acceptance in the United States to describe exterior plastering.

Stucco has been used to provide for an impermeable barrier and is effective even in wet climates. But stucco wall coverings are known to have certain problems, especially when stucco is used as a wall covering over dissimilar substrates, such as wood products and cement block. Various solutions have been tried to prevent cracking at joints between such dissimilar materials.

FIG. 1 illustrates a known control joint, a plastic extrusion, often implemented in a PVC type of material that is inexpensive and stable for exterior wall coverings. The known solution uses an upper flange without holes and a lower flange with holes. The upper flange is overlapped with a house wrap. A lathe and stucco are applied over the house wrap to provide an exterior wall covering. Theoretically, this construction should prevent water damage to an underlying substrate, such as wood or particle board or other typical building materials used above concrete block construction, and should prevent water intrusion due to cracking at the joint between the dissimilar materials.

In FIG. 1, the upper portion of the M-shaped control joint extends beyond lower portion of the M-shaped control joint by a distance D, which is supposed to prevent water shed by the stucco above the control joint from leaking into the joint between the lower point of the control joint and the stucco below the control joint. This is not always the case. So, FIG. 2 shows another known, but infrequently used, control joint that adds a drip flange extending from the portion of the M-shaped control joint that extends beyond the lower portion of the M-shaped flange. This is supposed to prevent water from following the M-shaped flange and penetrating at the seam between the lower portion of the control joint and the exterior stucco coating below the M-shaped control joint.

Yet, water damage still occurs at the control joint, regardless of whether a drip flange is used or not.

SUMMARY

It is thought, based on experience and observation, without being limiting in any way, that the M-shaped flange causes condensate, or any water that penetrates the structure behind the stucco above the control joint, to dam up above the control joint. Even a small amount of condensate can cause big problems if it remains dammed up by the control joint, unable to effectively drain. It causes water damage to the substrate and studs and can lead to the growth of mold and mildew, which can be hazardous to the health of humans inside of the structure, which is a serious problem.

For example, an existing control joint may be modified by adding drain channels to an upper, sloped surface of the control joint. A drainage member may be adhered to the upper, sloped surface, for example.

Alternatively, the control joint, itself, may contain a plurality of drainage channels that fluidically couple an upper surface to a drainage surface of the control joint.

In one example, a drip lip is provided such that the stucco is covered by the drip lip when the weeping control joint is installed on a building with stucco as the exterior surface.

In one example, a weeping control joint system comprises a substrate wall, the substrate wall being vertically oriented such that force of gravity is downward on any water standing on an exterior surface of the substrate wall, the substrate wall having a top portion and a bottom portion opposite of the top portion; an exterior wall covering having an exterior surface facing away from the exterior surface of the substrate wall, the exterior surface of the exterior wall covering being exposed to rain and weather, whereby the exterior wall covering covers the exterior surface of the substrate wall; a vent disposed at the top portion of the substrate wall such that air passes from outside the exterior surface of the exterior wall covering to the substrate wall via the vent; a weeping control joint disposed at a distance below the vent, the weeping control joint comprising a drainage structure wherein water collecting above the weeping control joint is directed through the drainage structure of the weeping control joint to the exterior surface of the exterior wall covering; and a pattern of channels disposed between the vent and the weeping control joint and between the exterior surface of the substrate wall and the exterior wall covering, the pattern of channels being in fluidic communication between the vent and the drainage structure of the weeping control joint such that liquid water disposed between the exterior wall covering and the exterior surface of the substrate wall flows under the influence of gravity through the pattern of channels to the drainage structure of the weeping control joint and through the drainage structure of the weeping control joint to the exterior surface of the exterior wall covering.

In one example, a drainage structure may be flexible and permeable to standing water. For example, the drainage structure may comprise a first layer of material permeable to water vapor and impermeable to liquid water, such as the water flowing through the pattern of channels. The first layer of material may be disposed between the exterior surface of the substrate wall and the pattern of channels and extending in one or more overlapping layers from the vent to the weeping control joint. A second layer of material may be permeable to standing liquid water, and the second layer of material may be disposed between the pattern of channels and the exterior wall covering and extending in one or more overlapping layers from the vent to the weeping control joint, wherein standing liquid water permeating the second layer flows under the influence of gravity through the pattern of channels.

In one example, the weeping control joint system may further comprise a flange extending outwardly from the weeping control joint into a portion of the exterior wall covering. This may be preferred when the exterior wall covering is stucco. The weeping control joint may comprise a lath and stucco layer wherein the stucco is filling at least some of the gaps in the lath such that the stucco is fixed by the lath to the substrate wall, the lath being disposed as a layer between the second layer of material and the exterior surface of the exterior wall covering. The weeping control joint system may have a seam. The seam may be formed by the butting together of a top substrate wall portion and a lower substrate wall portion disposed below the top substrate wall portion. In this example, the weeping control joint is disposed at the seam. The pattern of channels may be provided within a drainage member, and the drainage member may comprise a first layer permeable by water vapor and substantially impermeable by liquid water flowing through the pattern of channels, a second layer disposed opposite of the first layer, the second layer being sufficiently permeable to standing water such that standing water passes through the second layer, and a plurality of structures arranged between the first layer and the second layer keep the layers separated and define the pattern of channels.

In one example, a portion of the drainage member may extend from the substrate wall to the exterior surface of the exterior wall covering acting as the vent. In another example, the venting member may be a rigid plastic made of PVC or the like. For example, the rigid venting member may comprise a wind break and venting channels protected by the wind break, the venting channels being in fluid communication between the exterior environment and the pattern of channels. By "in fluid communication" and "fluid communication" it is meant that air and water may pass through without undue hindrance. The venting member may comprise a capture flange, also, wherein the capture flange comprises a return flange extending into the exterior surface of the stucco, when the stucco is added to the exterior as an external wall covering.

In one example, the drainage structure of the weeping control joint may comprise a drip lip. The drip lip may have a downwardly extending portion, and the downwardly extending portion may extend from a peak of the weeping control joint in a direction downwardly from the peak, such that a seam formed between exterior surface of the exterior wall covering, below the weeping control joint, and the weeping control joint is covered by the drip lip. For example, the drip lip may have a return portion extending transversely from the downwardly extending portion in the direction of the substrate wall and into the exterior surface of the exterior wall covering. The exterior wall covering may be stucco, and the stucco may be applied all the way under the drip lip. For example, the stucco may contact a surface of the drip lip facing the substrate wall. The return portion of the drip lip may be embedded in the stucco helping to secure the end of the stucco in the control joint. A pesticide may be included, which may prevent certain insects from using the drainage member as a bug run. For example, the pesticide may be D-limonene. The D-limonene may be disposed within a structure defining the pattern of channels, for example. Alternatively or in addition to adding the D-limonene to the polymer as an additive or a coating, the D-limonene may be disposed in a gap between the vent channel flange and the wind break flange of the venting member.

In alternative examples, a vent flange comprises venting channels, the venting channels being in fluid communication between the exterior environment and the pattern of channels and protected by a wind break flange. For example, the arrangement of the flanges may extend a capture flange from a support flange, directly, or indirectly from the venting flange. The various flanges provide air to the pattern of channels preventing vacuum lock and allowing unhindered flow of water through the channels under the influence of gravity alone, for example.

BRIEF DESCRIPTION OF THE DRAWINGS

The following drawings are illustrative examples and do not further limit any claims that may eventually issue.

When the same reference characters are used, these labels refer to similar parts in the examples illustrated in the drawings.

DETAILED DESCRIPTION

Figure 1:
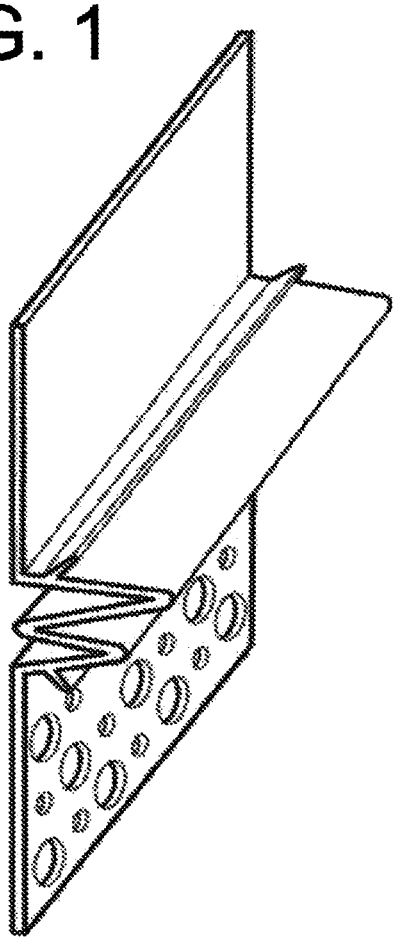
FIG. 1 illustrates a prior art midwall control joint.
Figure 2:
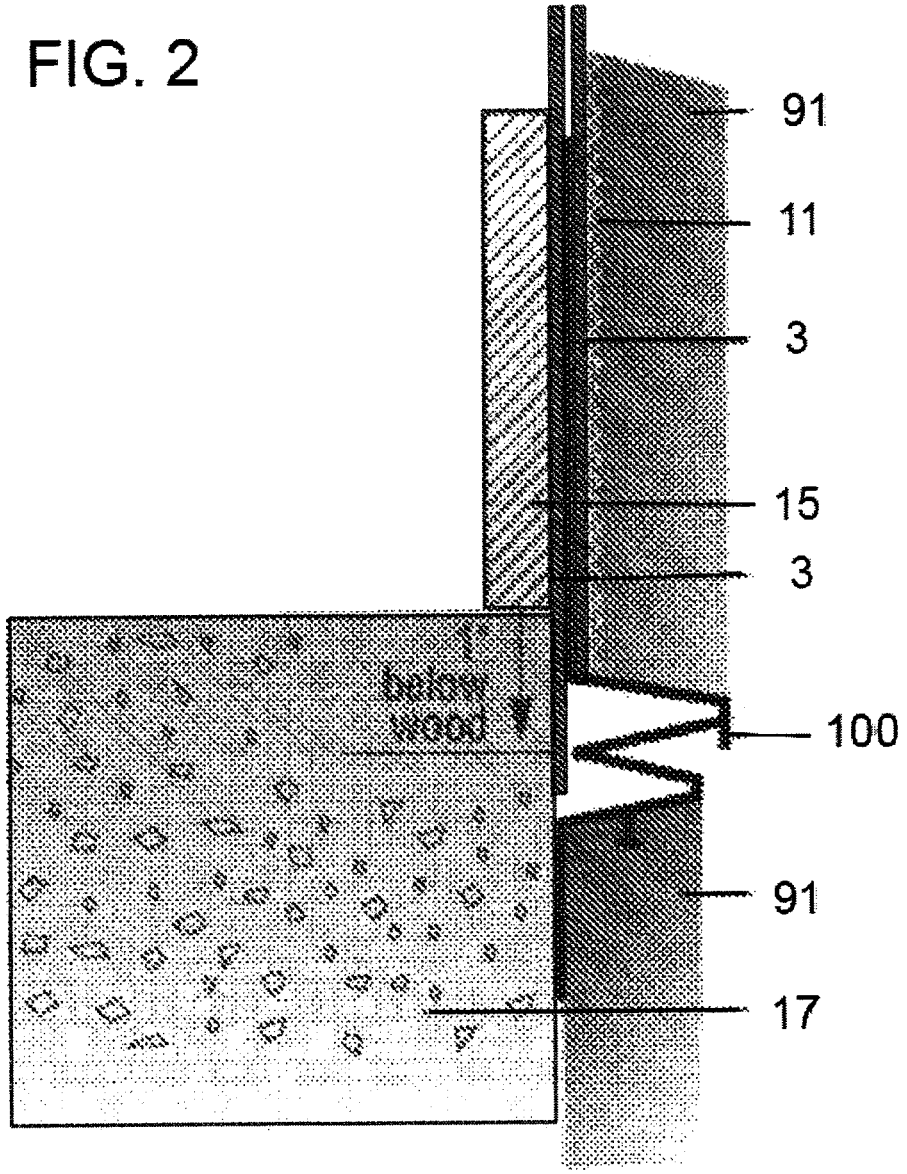
FIG. 2 illustrates another prior art midwall control joint as installed on an exterior wall of a building.

FIGS. 1 and 2 show examples of prior art midwall control joints. It is known that these control joints 100 do not prevent water damage from water that finds its way above the control joint, which are often installed horizontal to the ground where dissimilar substrates meet. For example, wood, plywood and particleboard may be used for an exterior substrate 15 on which stucco 91 may be adhered for an upper story, while concrete block or cement walls 17 may be covered with stucco 91 on lower stories. This type of construction might cause cracking of the exterior stucco surface at the seam where the dissimilar materials meet. The term particleboard, as used herein, is an industry term for panel types sometimes referred to variously as "chipboard," "flakeboard," "strandboard," or "waferboard," depending on size and shape of the wood particles used. (See ASTM D 1554, for example.) Almost all particleboard is produced by pressing a mat of resin-speckled particles flatwise in a heated press or extruded by forcing the resin-speckled particles between parallel heated dies. Based on personal observations and experience, water damage to particleboard and plywood at the seam is very common, and current solutions are inadequate to prevent this type of water damage, even if multiple layers of house wrap 3 or moisture barrier 3 are used to protect the underlying substrate. It has been observed that water builds up at prior art control joints 100 and flows laterally along the control joint to a seam, where it causes substantial damage to the underlying substrate materials 15 and causing mold, mildew, damage to the exterior stucco coating and other problems that are difficult and expensive to detect and remediate. The water may cause iron or steel lath 11 to rust and lose structural integrity, also.

Figure 3:
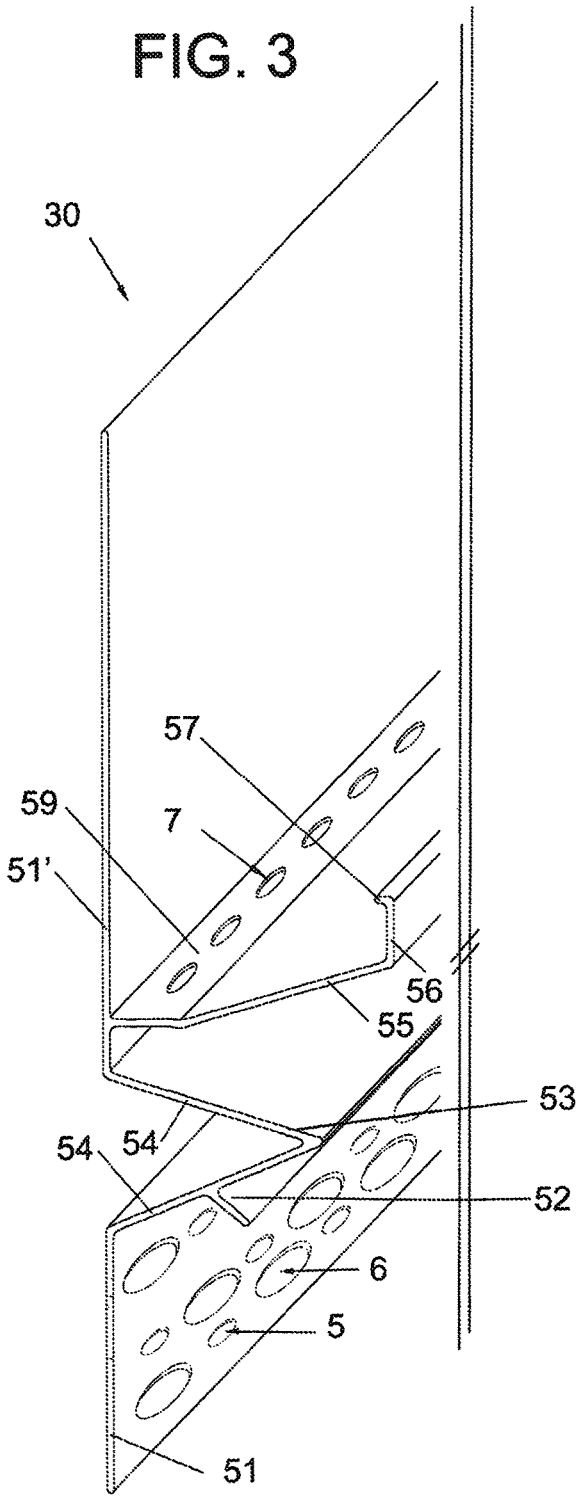
FIG. 3 illustrates a partial perspective view of an extrusion of a weeping control joint, which extends along a length that is shown truncated to allow the extrusion to fit in the space provided.

In FIG. 3, an extruded weeping control joint provides channels 7 that are capable of draining water that finds its way above the control joint to an exterior surface of the stucco, which is applied over at least a portion of the weeping control joint, as known in prior art. The weeping control joint 30 has a solid upper flange portion 51' and a lower flange portion 50 that has holes 5, 6. An upper portion 55 (56, 57, 59) of the control joint extends out further than a lower portion 54 of the control joint. For example, an A-shaped peak 53 of the lower portion 54 is shown that does not extend out as far as the return flange 56 of the upper portion 55. In this example, a drainage flange 59 couples the solid upper flange 51' and the upper portion 55 of the control joint. The drainage flange 59 comprises channels 7, such as holes or any other porous channel that allow water to pass through the drainage flange 59 and along the upper surface of the lower portion 54 to the exterior surface of the stucco. It is known in the art to apply stucco to cover the control joint. In FIG. 3 the stucco may be applied to the peak 53 of the lower portion 54 and to the return flange 56 of the upper portion 55. In this example, the upper portion 55 is angled upwards at a slope that returns any water to the channels 7 in the drainage flange 59. Alternatively, channels 7 may be provided in the upper portion 55 and/or the drainage flange 59.

Figure 5:
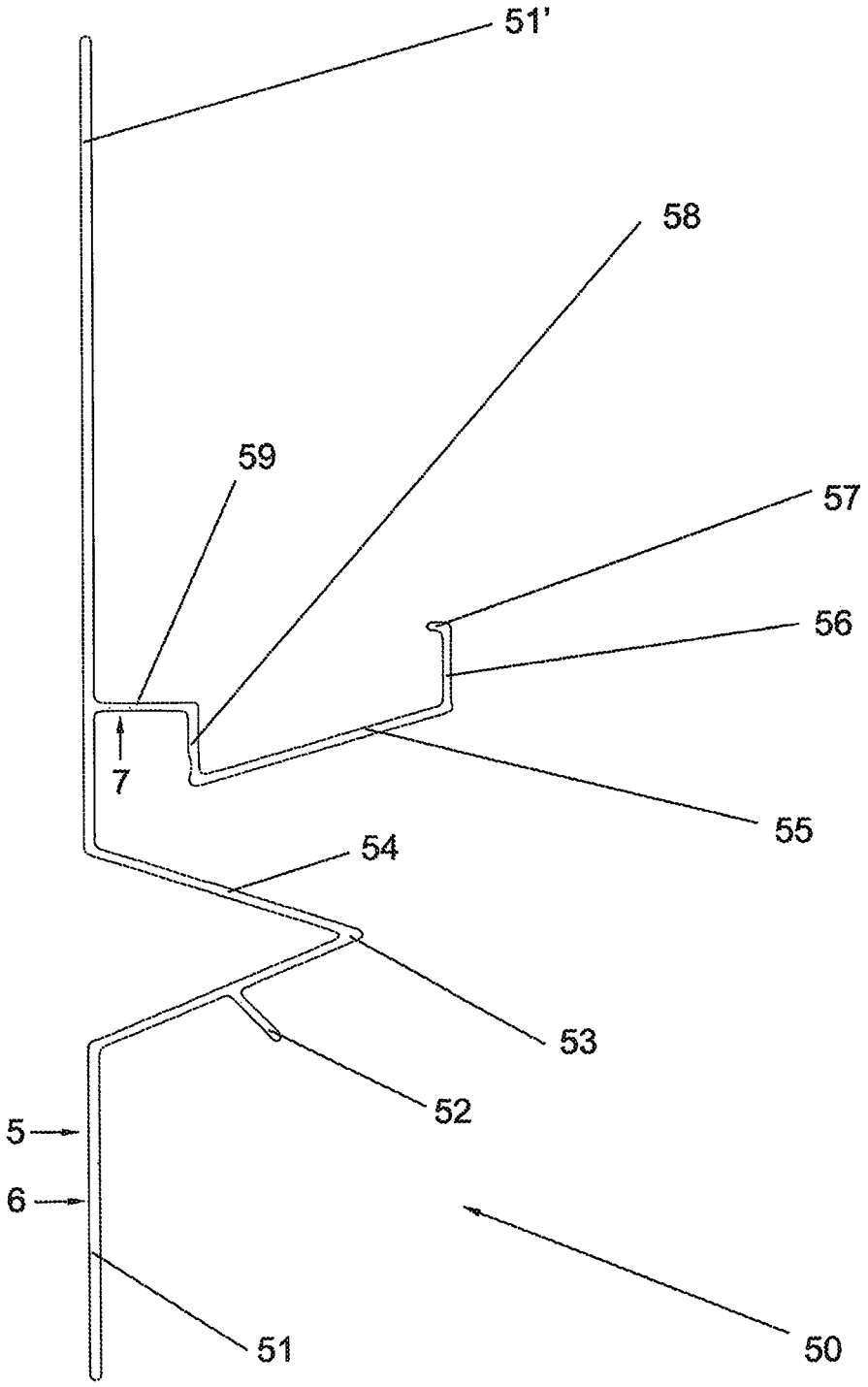
FIG. 5 illustrates an alternative profile view of a weeping control joint.

For example, FIG. 5 illustrates an example of an upper flange with an additional coupling flange 58 intermediate between the drainage flange 59 and the upper portion 55. In this example, channels 7 may pass through the drainage flange 59 and the upper portion 55, for example. Alternatively, the coupling flange 58 may make it easier to machine, stamp or otherwise provide the channels 7 in the drainage flange 59, for example.

Figure 4:
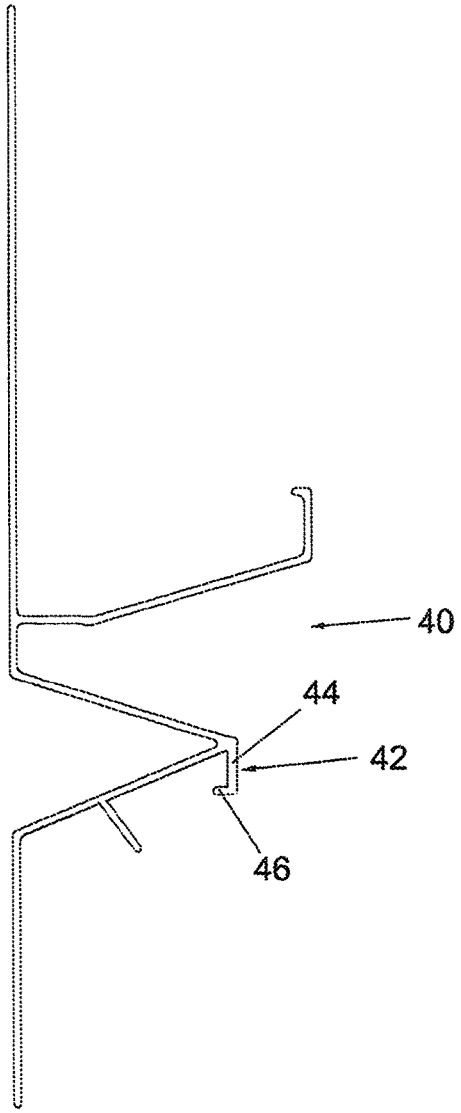
FIG. 4 illustrates a profile of another example of an extrusion of a weeping control joint, similar to the example in FIG. 3 but including a drip lip.
Figure 6:
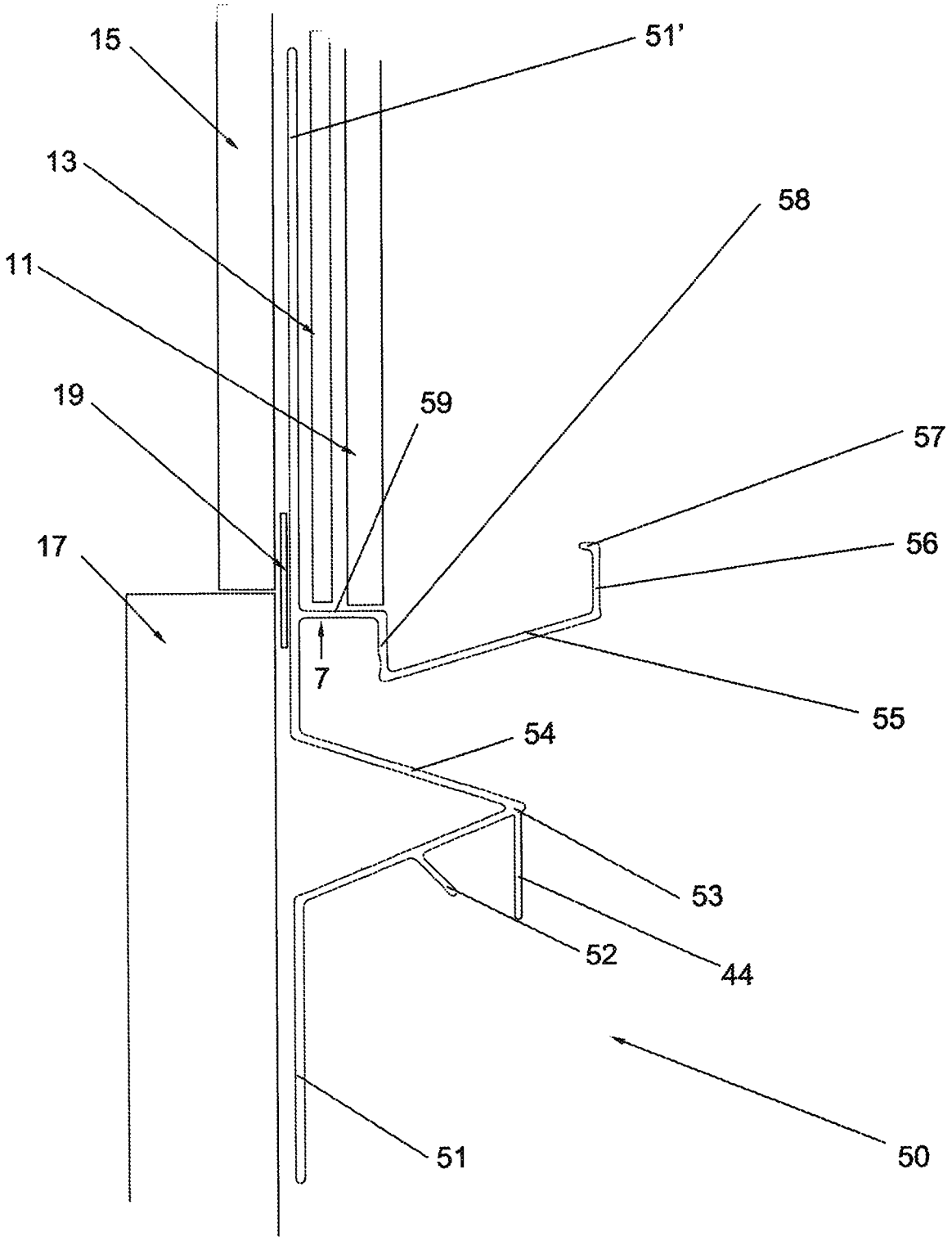
FIG. 6 illustrates another profile view of a weeping control joint schematically mounted on an external vertical surface of a building.

In the example of FIGS. 3-6, the lower portion 54 may have a protruding flange 52 extending from the lower surface of the lower portion 54, which helps to retain the stucco on the weeping control joint, without separating from the control joint. Alternatively, as illustrated in FIGS. 4 and 6, a drip lip 42, 44 may extend from the peak 53 downwardly from the peak 53, such that the seam between the stucco and the control joint is covered by a portion 44 of the drip lip. In FIG. 4, the drip lip 42 has a downwardly extending portion 44 and a return portion 46. Alternatively, FIG. 6 provides an example that shows the drip lip 44 as a flange without a return portion 46. In both examples, the drip lip 42, 44 serves to prevent water from finding its way between the stucco and the lower surface of the lower portion 54 of the control joints. This is substantially different than the prior art, which provides a drip edge extending from the upper portion, which still allows wind to drive water into the seam between the stucco and the lower portion of the control joint. In these examples, the stucco is applied all the way under and up to the drip lip and may be in contact with the drip lip, which is not the case in the prior art drip edge.

In the example of FIG. 6, a schematic of how a weeping control joint is installed on an exterior wall of a building is shown. For example, a concrete block or cement substrate 17 has a seam with a different material 15, such as plywood or particleboard, above the seam. A first layer 19 may be tape applied to the seam or may be a layer of house wrap that extends past the seam. The weeping control joint is attached with its upper flange 51' extending below the seam. Another layer 13, such as a housewrap layer, extends over the solid upper flange 51' of the weeping control joint 50. The control joint may be attached to the wall using fasteners, such as nails or screws, for example. While a lath is likewise attached to the exterior wall, especially where stucco is to be applied to wood products, such as plywood or particleboard. The lath 11 is necessary to keep the stucco adhered to the exterior wall if the exterior wall is not masonry. In one example, a housewrap layer 13 and the lath 11 are selected such that channels are provided to direct condensate or other sources of water to the channels 7 in the drainage flange 7. While not shown, the stucco is ordinarily applied in several layers, such as three layers, to fill in some or all of the lath and the void defined between the lath and the return flange 56 of the upper portion 55 of the weeping control joint 50. Likewise, stucco may be applied to fill the void defined by the lower flange 51 and the drip lip 44 extending from the peak 53.

Figure 7:
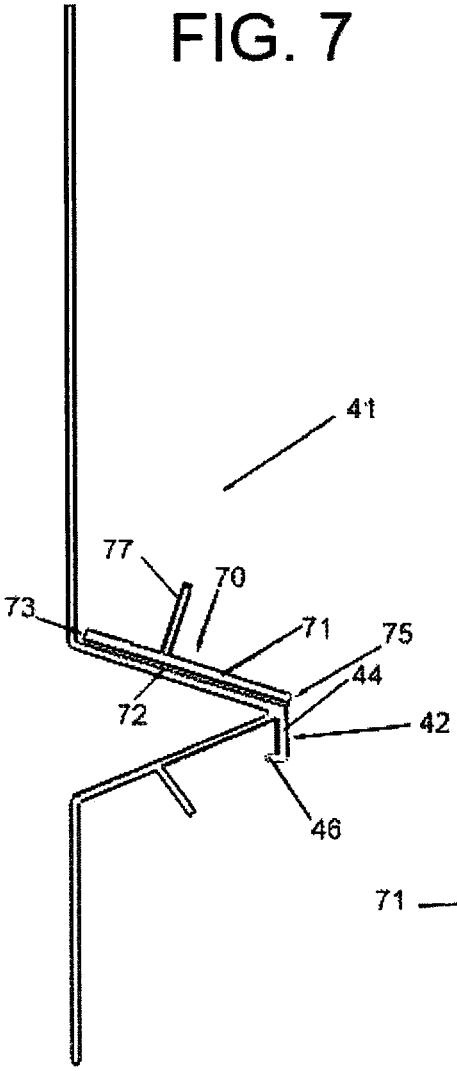
FIG. 7 illustrates another alterative weeping control joint with a drainage member.
Figure 8:
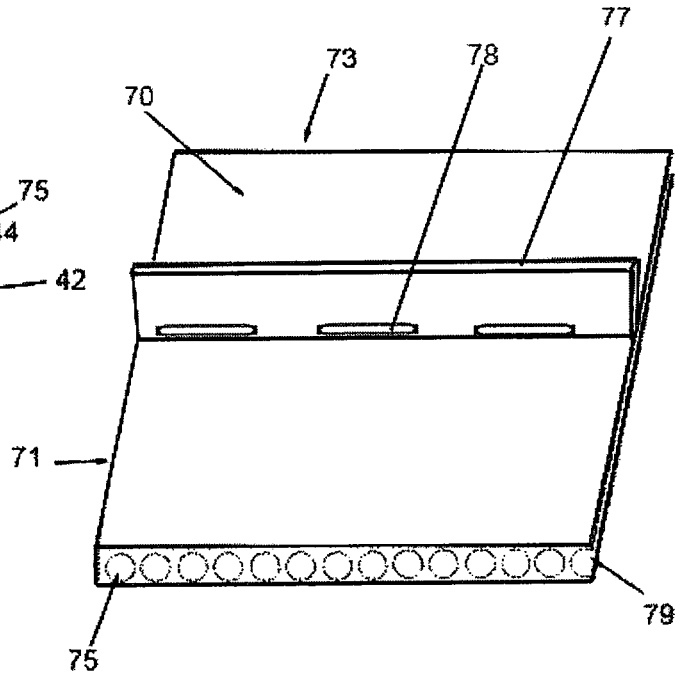
FIG. 8 is a detailed, partial cutaway, and perspective view of the example of the drainage member illustrated in FIG. 7.

FIGS. 7 and 8 illustrate another alternative for providing channels 75 to direct water to the exterior surface of stucco extending from the lower portion of the weeping control joint. In this example, a drainage member 70 has channels 79 extending through its width substantially parallel to an edge 71 of the member 70.

Figure 9:
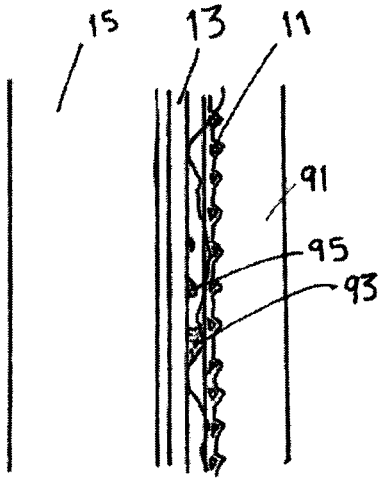
FIG. 9 illustrates a problem present in prior art systems.

In FIG. 9, a common problem with stucco is shown. The stucco 91 is applied to a lath 11 that is flush mounted on the exterior surface of wall substrate 15 (with or without a waterproofing layer 13). This is thought to trap condensation between the substrate and the stucco, which leads to mildew, mold and eventually structural damage. Condensate droplets 95 may consolidate and drip down the structure, and obstructions by the stucco or other wall covering may dam water into water damming pockets 93. The inventor has discovered that damage from water damming can be severe. Even if the stucco or other impermeable exterior wall covering does not result in water damning, a control joint may. It is not sufficient to provide holes through the control joint as water may still collect above the control joint and may find its way into the structure. Condensation or water leaking behind the stucco has only gravity to direct it through holes or slots or cracks but control joints are ordinarily disposed horizontally to the direction of gravity, which means water may run laterally to the direction of gravity and find openings or cracks in the structure.

Figure 10:
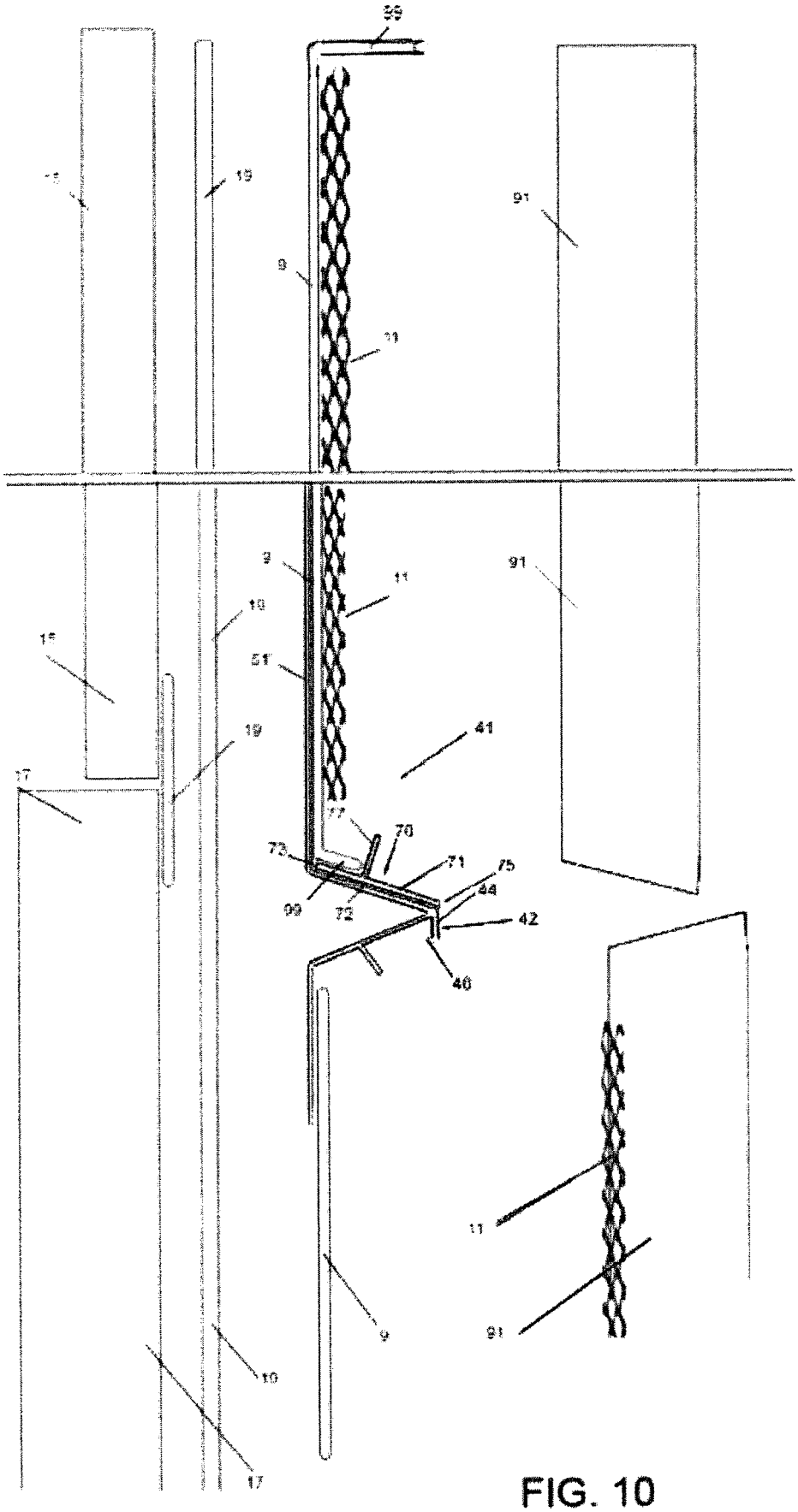
FIG. 10 is an example of a weeping control joint system with double lines showing that the view is a partial view of the elongated system.

In FIG. 10, a weeping control joint system is shown that provides for several advantages over known systems. The illustration is a partially exploded view to show the various layers of the system. In this example, the weeping control joint of FIG. 7 is shown as an example, but a control joint having the features disclosed in FIGS. 3-6 may be used, also. A house wrap tape 19, house wrap 19 or both may be used to seal seams between differing structural materials 15, 17, for example. A drainage member 9 is used for preventing damming and to provide venting in the example of FIG. 10.

The drainage member 9 provides a pattern of drainage channels. FIGS. 8, 11, 12 and 13 illustrate various examples of a pattern of channels that drain any water that accumulates between the wall substrate 15, 17 and the stucco 91. FIG. 8 illustrates a rigid drainage member 70 that may be adhered to a surface of a control joint providing a weeping control joint 41. In FIG. 8, a cutaway view shows that the channels 79 extend entirely through the width of the member 70 as shown in the partially cutaway channel 79, for example, from the front 75 to the rear 73 of the member 70. Water that enters the rear 73 drains from the front 75. While these are shown as simple conduits, any porous channels that permit water to flow through the member may be used to provide a drainage member 70. In this example, the drainage member 70 is adhered to the control joint by an adhesive layer 72. However, the member may be fused post extrusion or integrally extruded during the extrusion process. For example, a plurality of slots 78 may extend through a flange 77 projecting above an upper surface of the drainage member 70. These slots 78 may prevent an accumulation of water at the flange 77.

In the example illustrated in FIG. 10, the drainage member 9 is an improved house wrap having an inner layer 103 permeable to water vapor but not permeable to liquid water. An exterior layer 107 may be permeable to both water vapor and water; however, the exterior layer 107 is impermeable to stucco or other cementitious materials, for example. In one example, the exterior layer 107 is the same material as the inner layer 103, and the exterior layer 107 becomes permeable to water if water accumulates adjacent to the exterior layer 107. Then, the water accumulates in the pattern of channels 106 and drains under the force of gravity. A weeping control joint 30, 70 (with or without a drainage member 70) directs the water from the interior of the exterior coating or exterior surface to the exterior surface of the wall. In the portion of the system above the control joint in FIG. 10, a lath 11 is adhered to the surface of the drainage member 9, for example. In this example, applying the lath also applies the drainage member 9 to the exterior of the wall substrate 15. A portion of the drainage member 99 is shown extending beyond the lath 11 and is used to provide venting, with or without a separate venting control joint. In this example, the vent is established without the need of a separate venting control joint. An advantage of venting using only the pattern of channels of the drainage member 9 is the elimination of pathways for insects to access the structure behind the exterior wall covering such as stucco. In one example, an insecticide or repellant is added to a polymer or applied to a surface of a polymer that forms at least a portion of the drainage member 9. For example, D-limonene may be added to a polymer used in forming the pattern of channels.

The lower portion of the structure in FIG. 10, below the weeping control joint 70, illustrates how the stucco 91 permeates all or a portion of the lath 11. In this example, the lath is not adhered to the drainage member 9, and the drainage member is used as a house wrap 19 with or without another layer of house wrap 19. As is known in the prior art, lath may be applied to a structure by fastening the lath onto the substrate. Lath 11 is not necessary when stucco is adhered to masonry, but if the lower wall substrate 17 is not masonry, then lath may be necessary. In this case, the lath 11 may be applied using fasteners, such as staples, and the staples may used as normal, penetrating the drainage member 9 and/or the house wrap 19.

Figure 11:
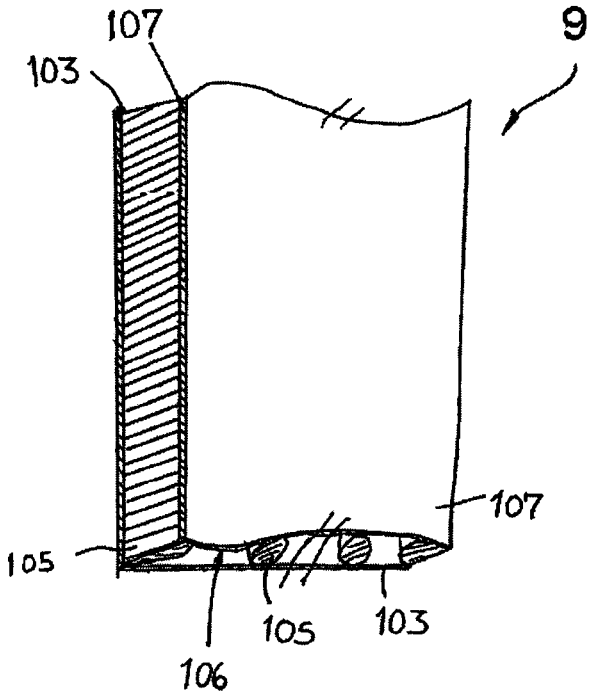
FIG. 11 is a detailed, partial cutaway, and perspective view of another example of a drainage member.

In FIG. 11 shows a partial cutaway view of another drainage member 9. This drainage member is flexible and may be used as a house wrap 19, for example. A plurality of structures 105, such as ridges or dots, define a void between two opposite layers 103, 107. The void comprises a pattern of open channels 106 fluidically coupled along the entire length of the drainage member 9, providing drainage channels for water. By "pattern of channels" it is meant any continuous open channels that are capable of providing drainage. In the example in FIG. 11, the structures 105 are elongated and formed of a polymer. The polymer is a polymer capable of being adhered between the layers 103, 107 using an automated apparatus that heats the polymer to soften the polymer and to make it tacky to the layers 103, 107. Alternative methods of creating a pattern of channels 106 between the layers 103, 107 may be used.

Figure 12:
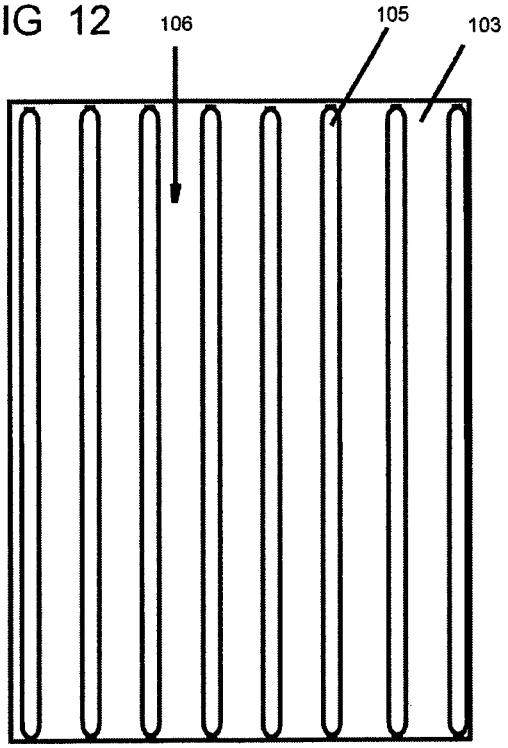
FIG. 12 is a detailed partial cutaway view showing an example of a pattern of channels inside a drainage member.
Figure 13:
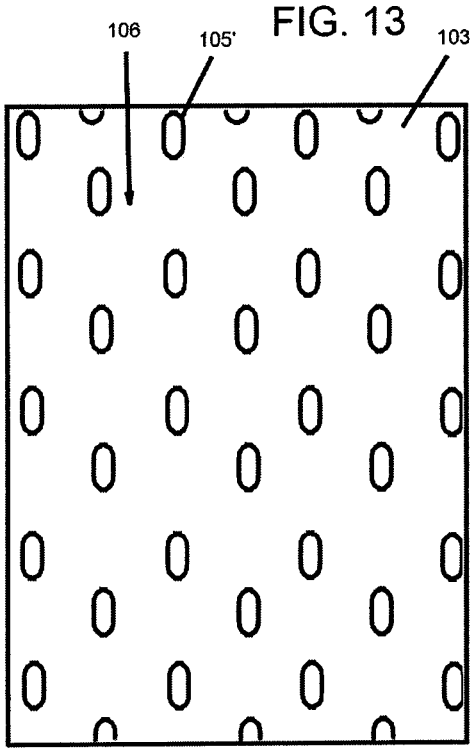
FIG. 13 is a detailed partial cutaway view showing another example of a pattern of channels inside a drainage member.

FIG. 12 shows an example similar to the example in FIG. 11, except the exterior layer 107 is removed to show the elongated structures 105. FIG. 13 shows an alternative example, using dots 105' to separate and adhere the two layers 103, 107 together. The pattern of channels 106 remains as open channels but forms a network of interconnected channels. This may be preferably as fasteners extending through the channels will have little effect on drainage.

Figure 14:
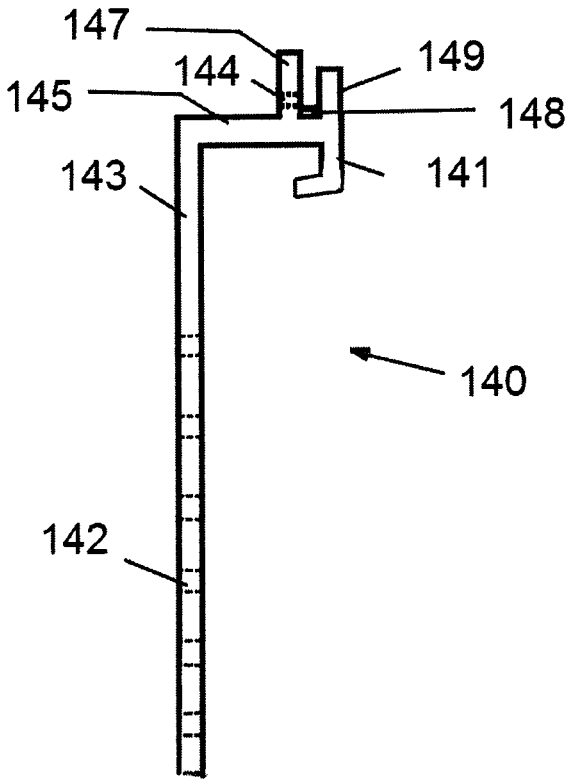
FIG. 14 illustrates an example of a venting member.

In one example, as illustrated in FIG. 14, an extruded venting member provides a plurality of vent channels 144, which may be through holes, slots, slits or other openings to provide fluid communication from the exterior environment to a substrate wall. The vent channels 144 are shown as dashed lines and pass through the vent channel flange 147. The vent channels 144 are protected by a wind break flange 149. The wind break flange 149 in this example leaves a gap between the top of the wind break flange 149 and the top of the vent channel flange 147. Alternatively, the wind break flange 149 and the vent channel flange 147 may be swapped one for the other, without affecting the functioning of the two flanges. As shown in the drawing, a pesticide 148 may be provided in the trough defined between the vent channel flange 147 and the wind break flange 149. For example, the trough may contain an orange oil or D-limonene. A capture flange 141 may be provided for use with stucco, for example. A support flange 143 is provided for attachment of the venting member 140 to a substrate wall using one or more of the plurality of holes 142 that are provided through the support flange 143. The capture flange 147, vent flange 147 and wind break flange 149 are coupled to the support flange 143 by the connecting flange 145. The support flange 143 of the venting member 140 may abut up against the drainage member 9, for example, providing fluid communication to the drainage member 9 from the exterior environment.

Figure 15:
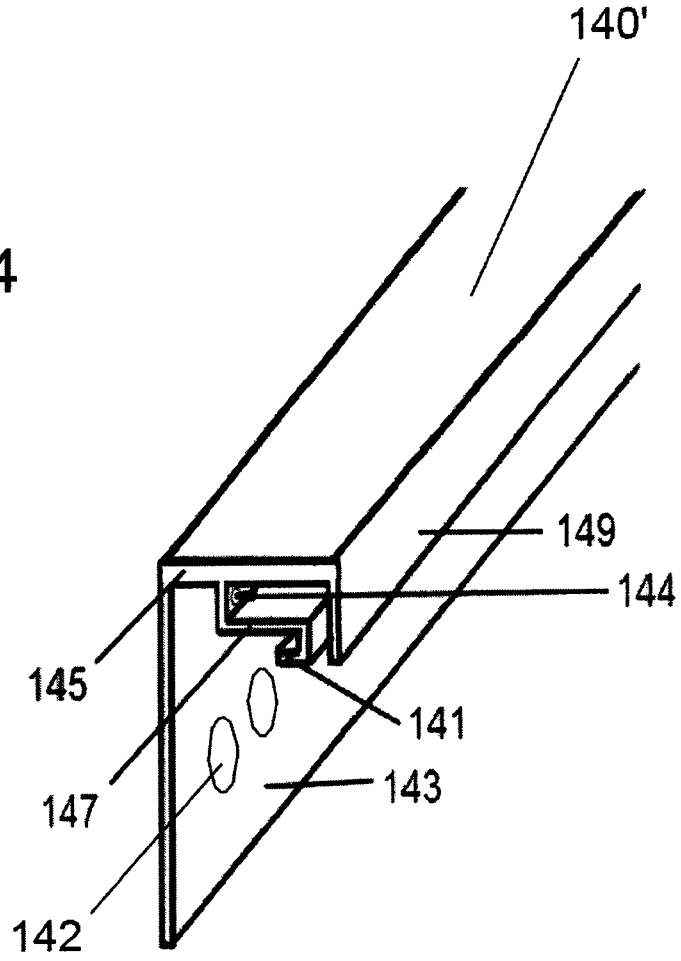
FIG. 15 illustrates another example of a venting member.

In another example, as illustrated in FIG. 15, an extruded venting member provides a plurality of vent channels 144, which may be through holes, slots, slits or other openings to provide fluid communication from the exterior environment to the substrate wall. One representative vent channel 144 is shown, which passes through the vent channel flange 147. The vent channels 144 are protected by a wind break flange 149. In this example, the wind break flange 149 provides a gap between wind break flange 149 extending beyond the surface of the stucco and the vent channel flange 147. A capture flange 141 extends from the vent channel flange 147 use with stucco. A support flange 143 is provided for attachment of the venting member 140 to a substrate wall using one or more of the plurality of holes 142 that are provided through the support flange 143. The capture flange 147, vent flange 147 and wind break flange 149 are coupled to the support flange 143 by the connecting flange 145. The support flange 143 of the venting member 140 may abut up against the drainage member 9, for example, providing fluid communication to the drainage member 9 from the exterior environment, and in this example, the connecting flange 145 may abut up against a soffit, for example.

This detailed description provides examples including features and elements of the claims for the purpose of enabling a person having ordinary skill in the art to make and use the inventions recited in the claims. However, these examples are not intended to limit the scope of the claims, directly. Instead, the examples provide features and elements of the claims that, having been disclosed in these descriptions, claims and drawings, may be altered and combined in ways that are known in the art.

What is claimed is:

1. A weeping control joint system comprises:

a substrate wall, the substrate wall being vertically oriented such that force of gravity is downward on any water standing on an exterior surface of the substrate wall, the substrate wall having a top portion and a bottom portion opposite of the top portion;

an exterior wall covering having an exterior surface facing away from the substrate wall, whereby the exterior surface is exposed to rain and weather, and whereby the exterior wall covering covers the exterior surface of the substrate wall;

a vent disposed at the top portion of the substrate wall such that air passes from the top portion of the substrate wall from outside the exterior surface of the exterior wall covering at the top portion of the substrate wall to the substrate wall and downward via the vent;

a weeping control joint disposed at a distance below the vent, the weeping control joint comprising a drainage structure, arranged such that the drainage structure of the weeping control joint is in fluid communication with vent, wherein water collecting above the weeping control joint is directed through the drainage structure of the weeping control joint to the exterior surface of the exterior wall covering;

a pattern of channels disposed between the vent and the weeping control joint and between the exterior surface of the substrate wall and the exterior wall covering, the pattern of channels being in fluidic communication between the vent and the drainage structure of the weeping control joint such that air from the vent above the pattern of channels vents the pattern of channels wherein liquid water between the exterior wall covering and the exterior surface of the substrate wall flows under the influence of gravity through the pattern of channels to the drainage structure of the weeping control joint and through the drainage structure of the weeping control joint to the exterior surface of the exterior wall covering; and a pesticide disposed in a gap of the weeping control joint system such that the pesticide prevents certain insects from using the weeping control joint system as a bug run.

2. The weeping control joint system of claim 1, further comprising a first layer of material permeable to water vapor and impermeable to liquid water, the first layer of material being disposed between the exterior surface of the substrate wall and the pattern of channels and extending in one or more overlapping layers from the vent to the weeping control joint.

3. The weeping control joint system of claim 2, further comprising a second layer of material permeable to standing liquid water, the second layer of material being disposed between the pattern of channels and the exterior wall covering and extending in one or more overlapping layers from the vent to the weeping control joint, wherein standing liquid water permeating the second layer flows under the influence of gravity through the pattern of channels.

4. The weeping control joint system of claim 3, further comprising a flange extending outwardly from the weeping control joint into a portion of the exterior wall covering.

5. The weeping control joint system of claim 4, wherein the exterior wall covering comprises a lath and stucco layer wherein the stucco is filling at least some of the gaps in the lath such that the stucco is fixed by the lath to the substrate wall, the lath being disposed as a layer between the second layer of material and the exterior surface of the exterior wall covering.

6. The weeping control joint system of claim 5, further comprising a seam, wherein the seam is formed by the butting together of the substrate wall and a lower substrate wall disposed below the substrate wall, and the weeping control joint is disposed at the seam.

7. The weeping control joint system of claim 1, wherein the pattern of channels is defined by a first layer permeable by water vapor and substantially impermeable by liquid water flowing through the pattern of channels, a second layer disposed opposite of the first layer and being sufficiently permeable to standing water such that standing water passes through the second layer, and a plurality of structures arranged between the first layer and the second layer.

8. The weeping control joint system of claim 7, wherein a portion of the pattern of channels extends from the substrate wall to the exterior surface of the exterior wall covering acting as the vent.

9. The weeping control joint system of claim 1, further comprising a venting member, wherein the venting member comprises a wind break and venting channels protected by the wind break, the venting channels being in fluid communication between the exterior environment and the pattern of channels.

10. The weeping control joint system of claim 9, wherein the venting member further comprises a capture flange, wherein the capture flange comprises a return flange extending into the exterior surface of the stucco.

11. The weeping control joint system of claim 1, wherein the drainage structure of the weeping control joint comprises a drip lip.

12. The weeping control joint system of claim 11, wherein the drip lip downwardly extends from a peak of the weeping control joint, the peak comprising a first peak surface extending outwardly and downwardly from the drainage structure and a second peak surface extending from the first peak surface in a inwardly and downwardly direction, the change in direction from the first peak surface to the second peak surface defining the peak, the drip lip extending from the peak in a direction downwardly from the peak, such that a seam formed between exterior surface of the exterior wall covering below the peak and a portion of the second peak surface below the peak is covered by the drip lip.

13. The weeping control joint system of claim 12, wherein the drip lip has a return portion extending transversely from the downwardly extending portion in the direction of the substrate wall and into the exterior surface of the exterior wall covering.

14. The weeping control joint system of claim 13, wherein the exterior wall covering is stucco, and the stucco is applied all the way under the drip lip.

15. The weeping control joint system of claim 14, wherein the stucco contacts a surface of the drip lip facing the substrate wall.

16. The weeping control joint system of claim 15, wherein the return portion of the drip lip is embedded in the stucco.

17. The weeping control joint system of claim 1, wherein the pesticide is D-limonene.

18. The weeping control joint system of claim 17, wherein D-limonene is applied to a surface of a polymer that forms at least a portion of the drainage structure of the weeping control joint.

19. The weeping control joint system of claim 9, wherein the gap of the weeping control joint system is disposed between the wind break of the venting member and the pattern of channels.

* * * * *